US006889972B2

(12) United States Patent
Chang

(10) Patent No.: US 6,889,972 B2
(45) Date of Patent: May 10, 2005

(54) BANKNOTE DISPENSER

(75) Inventor: Hung-Yi Chang, Chilung (TW)

(73) Assignee: International Currency Technologies Corporation, Taipei (TW)

( * ) Notice: Subject to any disclaimer, the term of this patent is extended or adjusted under 35 U.S.C. 154(b) by 150 days.

(21) Appl. No.: 10/400,672

(22) Filed: Mar. 28, 2003

(65) Prior Publication Data

US 2004/0188914 A1 Sep. 30, 2004

(51) Int. Cl.[7] ..... B65H 3/30
(52) U.S. Cl. ..... 271/23; 271/119; 271/125; 271/10.03; 902/15
(58) Field of Search ..... 271/23, 119, 125, 271/10.03

(56) References Cited

U.S. PATENT DOCUMENTS 4,232,860 A * 11/1980 Brown ..... 271/119
4,653,742 A * 3/1987 Sasaki et al. ..... 271/114
5,207,788 A * 5/1993 Geib et al. ..... 271/122
6,186,490 B1 * 2/2001 Sugiura et al. ..... 271/10.09

FOREIGN PATENT DOCUMENTS

DE 102 24 486 A 1 * 11/2003 ..... B65H/3/02

* cited by examiner

*Primary Examiner*—Donald P. Walsh
*Assistant Examiner*—Kenneth W. Bower
(74) *Attorney, Agent, or Firm*—Rabin & Berdo, P.C.

(57) ABSTRACT

A banknote dispenser is constructed to include a housing adapted to hold banknotes in a stack for dispensing, a power module, a transferring wheel set driven by the power module to spread a stack of banknotes into a stepped stack of banknotes and then to dispense banknotes individually by a respective push block being rotated with a respective wheel of the transferring wheel set, an output wheel set adapted to transfer banknotes individually from the transferring wheel set to a banknote outlet, and a sensor adapted to control the operation of the power module subject to the presence of banknotes in the housing.

12 Claims, 7 Drawing Sheets

BANKNOTE DISPENSER

BACKGROUND OF THE INVENTION

1. Field of the Invention

The present invention relates generally to banknote dispensers and, more particularly, to such a banknote dispenser which uses a first wheel and a second wheel to rotate a respective push block to push banknotes, enabling banknotes to be transferred to an outlet individually by an output wheel set.

2. Description of the Related Art

Automatic ticket or card vending machines or money exchange machines are commonly used in public transportation stations and public places. These machines commonly use a dispensing device to dispense tickets, cards, or banknotes. FIG. 9 illustrates a banknote dispenser according to the prior art. This structure of banknote dispenser A comprises a receiving chamber A1 adapted to hold a stack of banknotes C, a set of transferring wheels A2 adapted to transfer banknotes C to the outside of the banknote dispenser A, a motor A3 adapted to drive the transferring wheels A2, and an adjustment device B adapted to adjust the pitch through which an individual banknote C passes. This design of banknote dispenser has drawbacks. Because the transferring wheels A2 are friction wheels molded from, for example, rubber. When rubbing over a stack of banknotes C in the receiving chamber A1, a number of banknotes C may simultaneously be carried forwards. However, because the pitch controlled by the adjustment device B allows only one individual banknote C to pass. At this time, dispensed banknotes C may be stuck in the pitch controlled by the adjustment device B, thereby causing the machine to shut down.

SUMMARY OF THE INVENTION

The present invention has been accomplished to provide a banknote dispenser, which eliminates the aforesaid drawbacks. According to one aspect of the present invention, the banknote dispenser comprises a housing, the housing comprising a banknote outlet, a substrate provided on the inside, and a receiving chamber defined on the inside above the substrate and adapted to hold a stack of banknotes; a power module mounted in the housing below the substrate, the power module comprising a motor and a gear set coupled to the motor; a transferring wheel set coupled to the gear set and adapted to transfer banknotes from the receiving chamber to the banknote outlet, the transferring wheel set comprising a first wheel, a second wheel, and a third wheel respectively coupled to the gear set of the power module for synchronous rotation, the first wheel comprising a push block adapted to spread a stack of banknotes been put in the receiving chamber into a stepped stack of banknotes, the second wheel comprising a push block adapted to dispense the stepped stack of banknotes; and an output wheel set adapted to transfer banknotes individually from the transferring wheel set to the banknote outlet, the output wheel set comprising a banknote dispensing wheel adapted to work with the push block of the first wheel in spreading a stack of banknotes been put in the receiving chamber into a stepped stack of banknotes, an adjustment wheel adapted to work with the second wheel in transferring banknotes individually from the banknote dispensing wheel toward the banknote outlet, and a plurality of impression wheels peripherally disposed in contact with the second wheel and the third wheel and adapted to transfer banknotes individually from the adjustment wheel toward the banknote outlet. According to another aspect of the present invention, the position of the adjustment wheel can be adjusted to control the pitch between the adjustment wheel and the second wheel, for enabling only one individual banknote to pass at a time. According to still another aspect of the resent invention, a sensor is provided to detect the presence of banknotes in the receiving chamber and to automatically control the operation of the motor subject to the presence of banknotes in the receiving chamber.

DETAILED DESCRIPTION OF THE INVENTION

Figure 1:
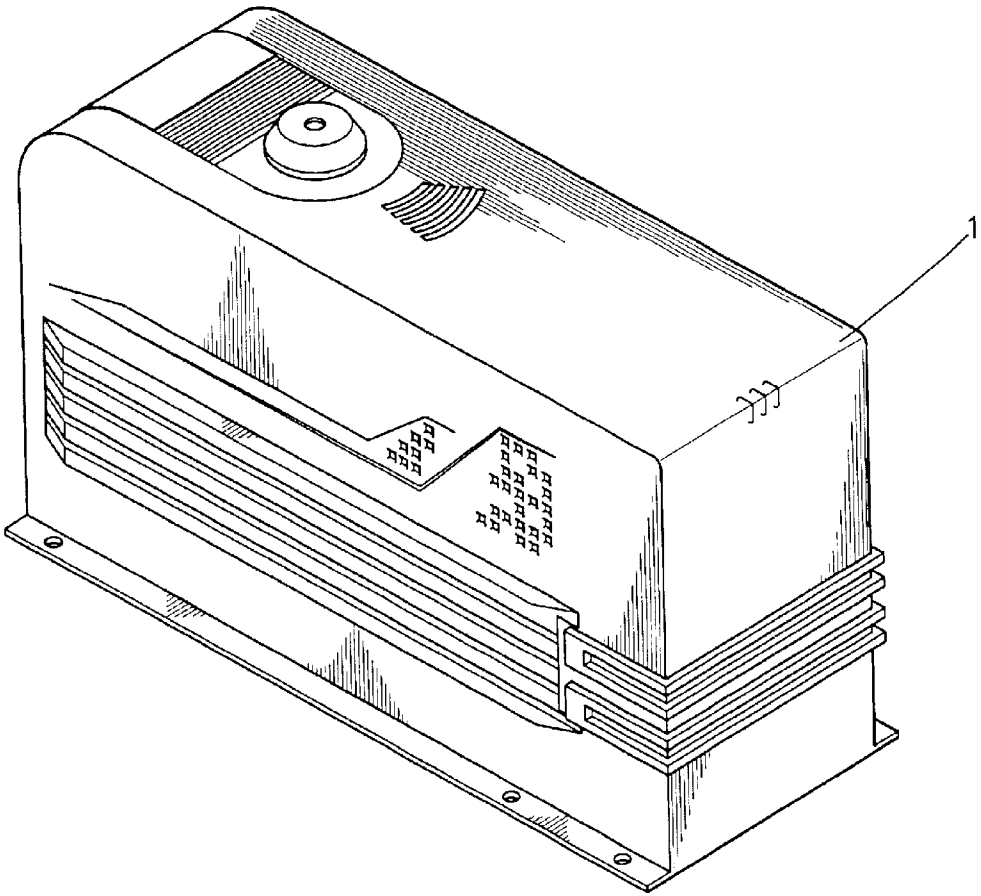
FIG. 1 is an elevational view of a banknote dispenser according to the present invention.
Figure 2:
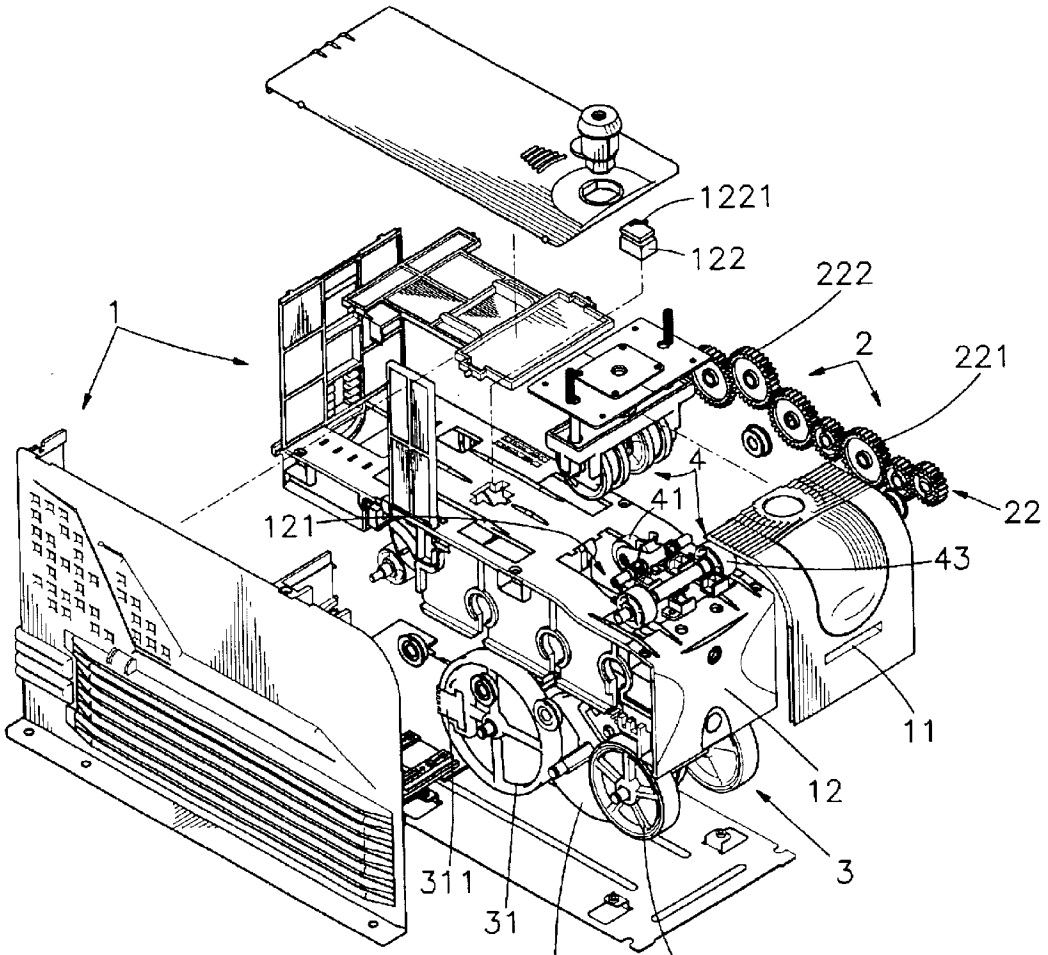
FIG. 2 is an exploded view of the banknote dispenser according to the present invention.

Referring to FIGS. 1 and 2, a banknote dispenser is shown comprised of a housing 1, a power module 2, a transferring wheel set 3, and an output wheel set 4.

The housing 1 comprises a banknote outlet 11, a substrate 12 provided on the inside, a receiving chamber 13 defined on the inside above the substrate 12, and a sensor 122 installed in the substrate 12 inside the receiving chamber 13. The substrate 12 has a plurality of slots 121. The sensor 122 has a probe 1221.

Figure 3:
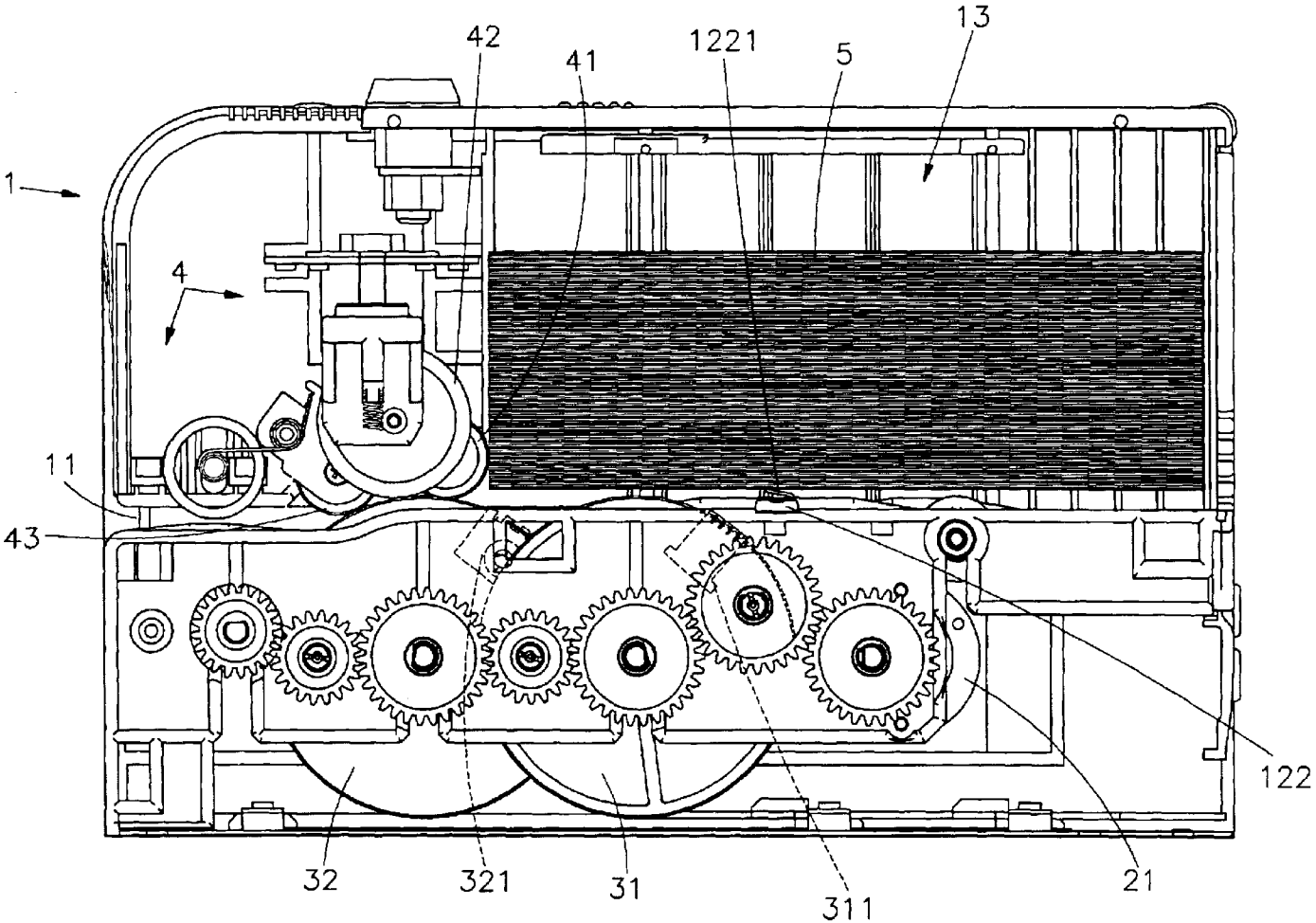
FIG. 3 is a side plain view of the present invention before dispensing action.
Figure 4:
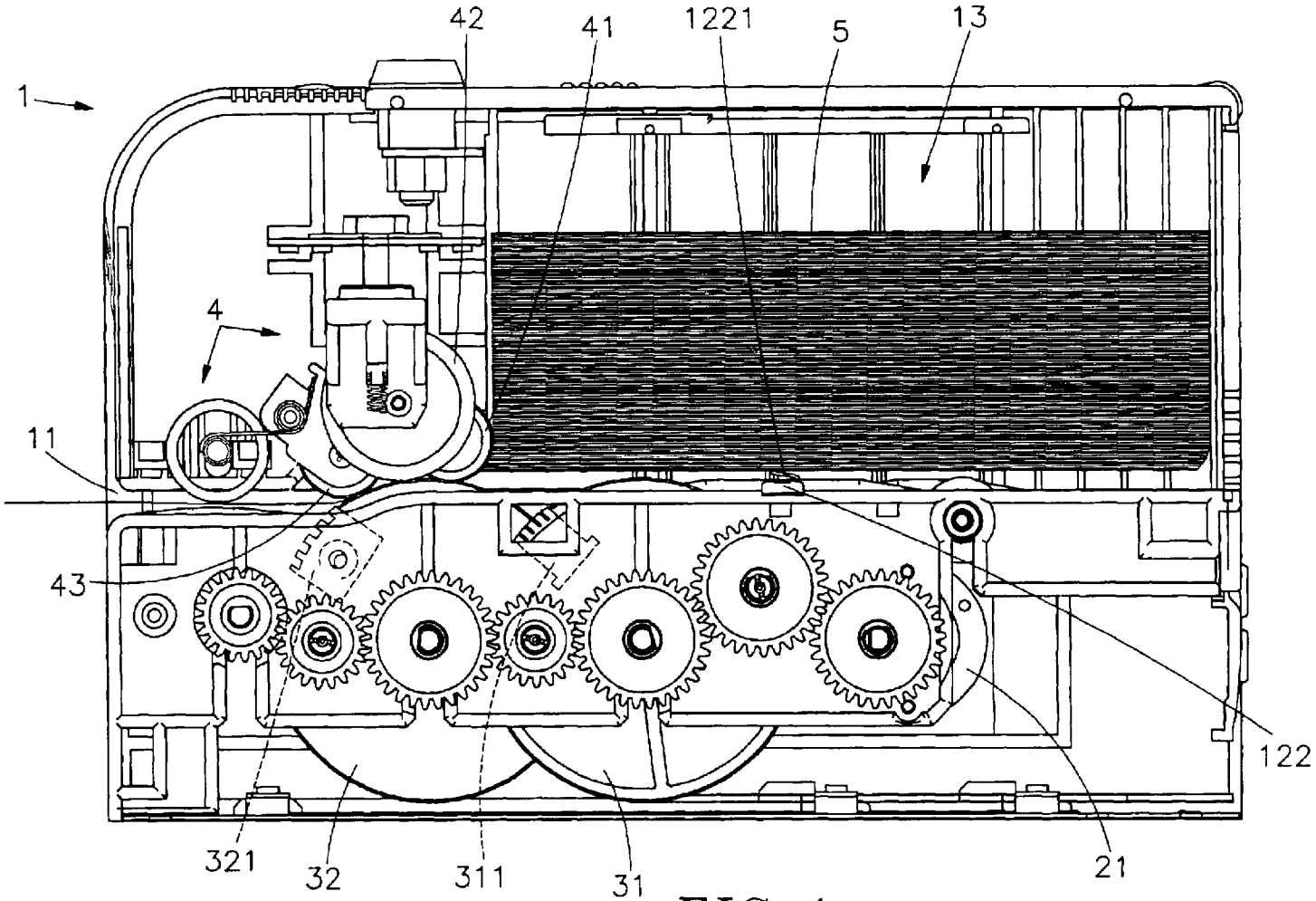
FIG. 4 is similar to FIG. 3 but showing the banknote dispenser operated.
Figure 5:
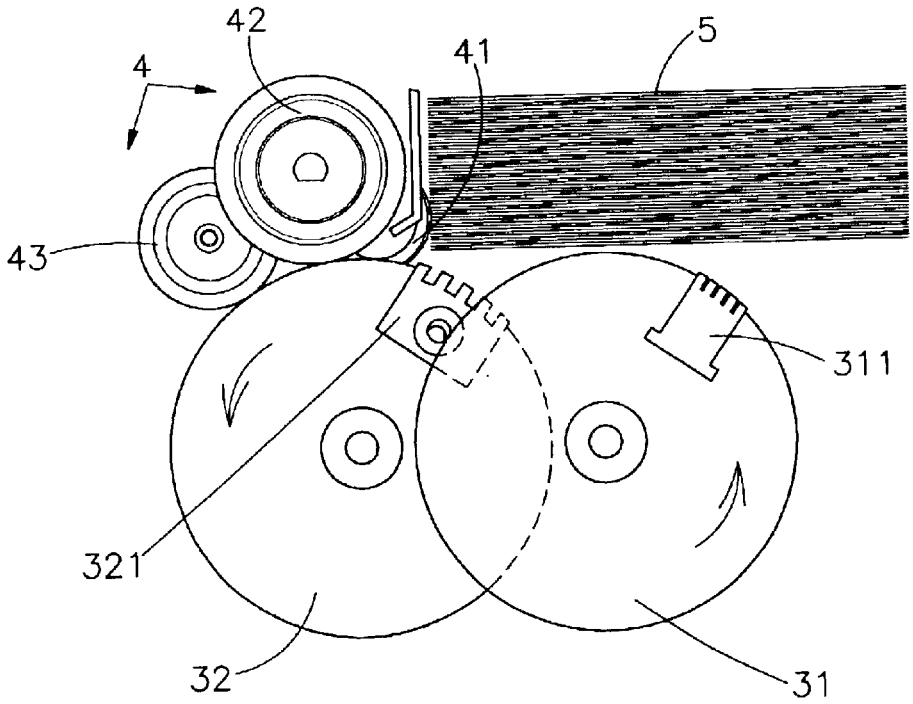
FIG. 5 is a schematic drawing showing the action of the transferring wheel set and the output wheel set according to the present invention (I).
Figure 6:
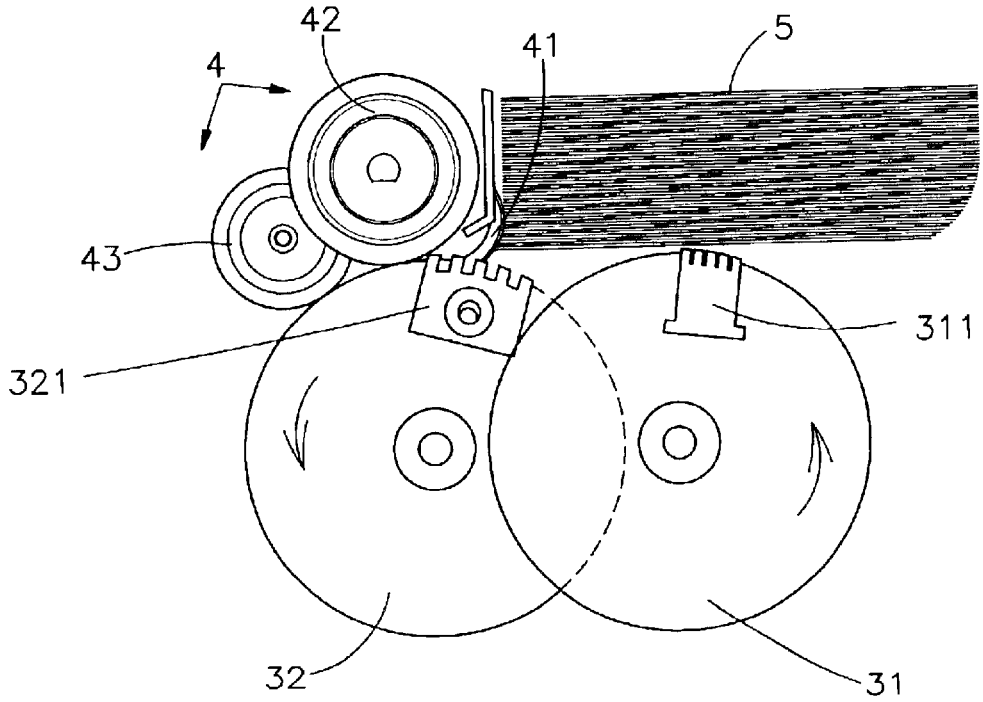
FIG. 6 is a schematic drawing showing the action of the transferring wheel set and the output wheel set according to the present invention (II).
Figure 7:
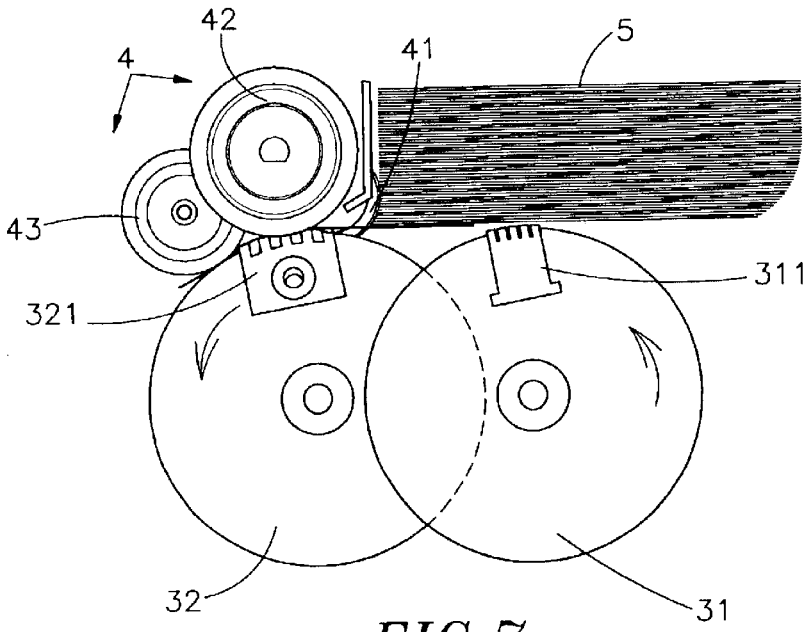
FIG. 7 is a schematic drawing showing the action of the transferring wheel set and the output wheel set according to the present invention (III).
Figure 8:
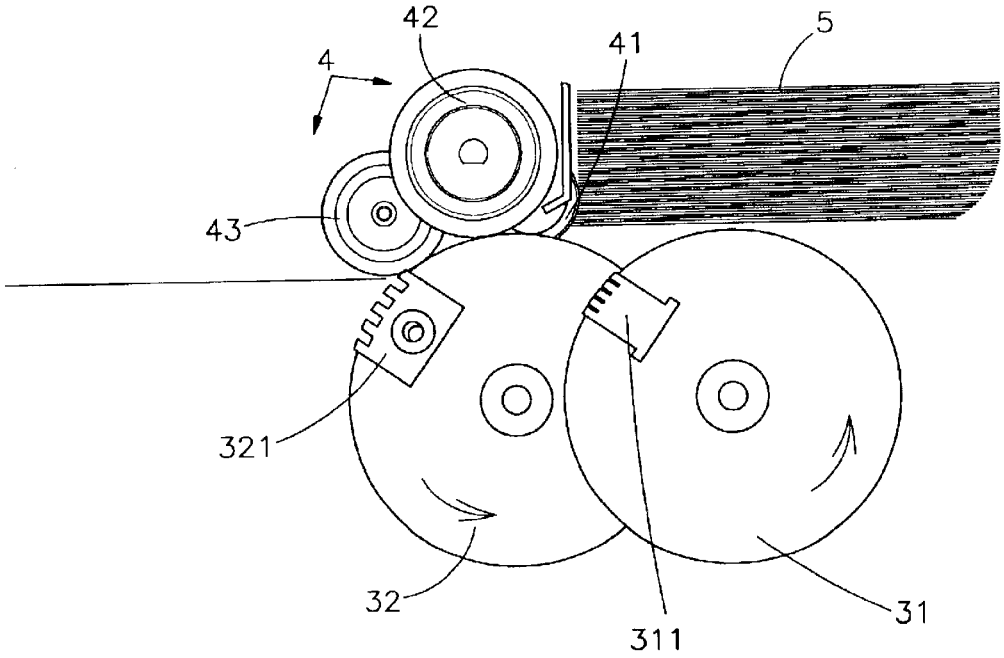
FIG. 8 is a schematic drawing showing the action of the transferring wheel set and the output wheel set according to the present invention (IV).
Figure 9:
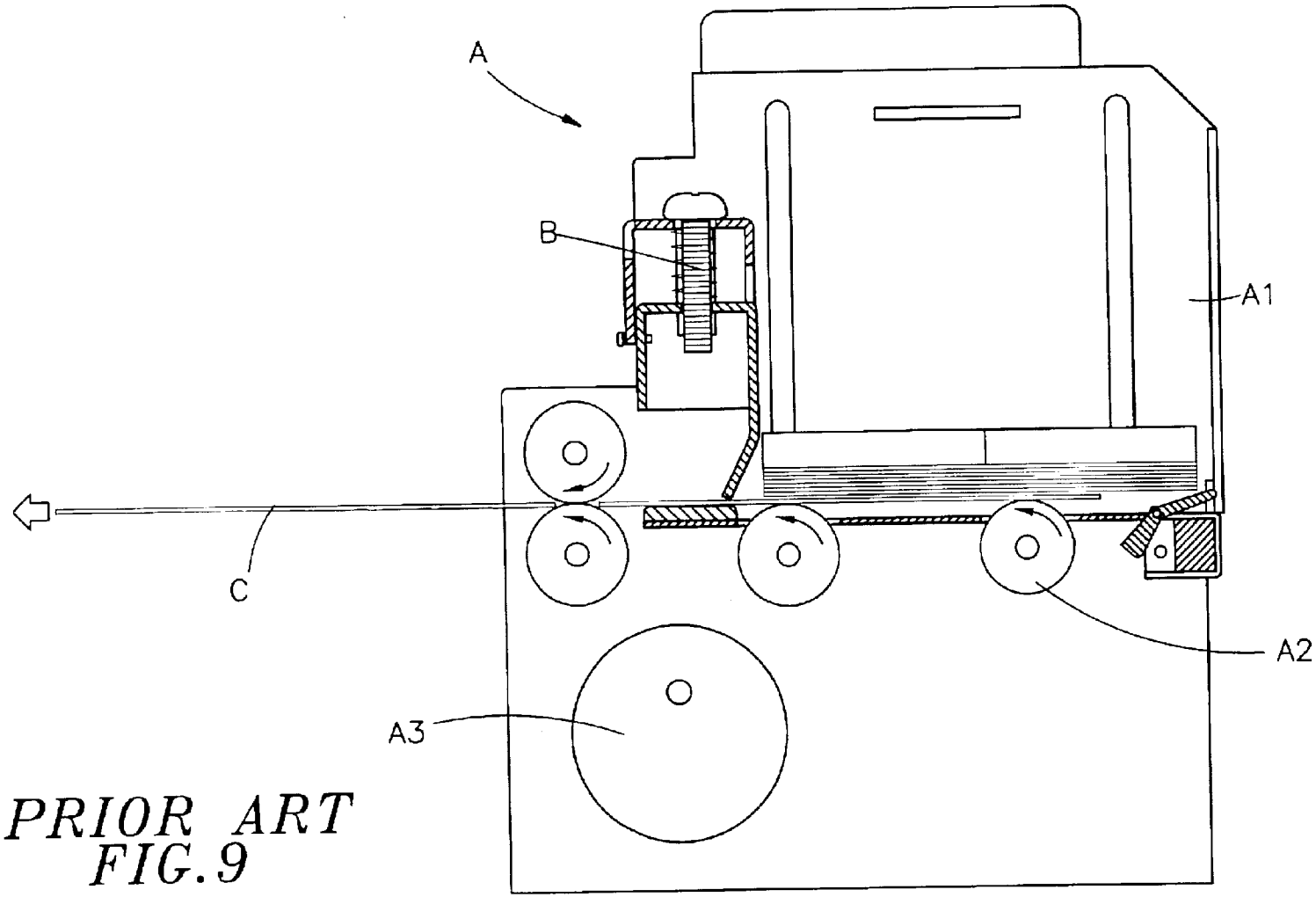
PRIOR ART FIG. 9
FIG. 9 is a side view in section of a banknote dispenser according to the prior art.

The power module 2 is provided inside the housing 1 below the substrate 12, comprising a motor 21 (see also FIG. 3) and a gear set 22. The gear set 22 is comprised of a plurality of driven gears 221 and a plurality of transmission gears 222. The transmission gears 222 are respectively meshed between each two adjacent driven gears 221.

The transferring wheel set 3 comprises a first wheel 31, a second wheel 32, and a third wheel 33 respectively coupled to the driven gears 221 of the gear set 22 of the power module 2. The first wheel 31 and the second wheel 32 each have a push block 311 or 321. The push blocks 311 and 321 are preferably molded from rubber and toothed.

The output wheel set 4 is mounted in the front side of the receiving chamber 13 of the housing 1 above the substrate 12, comprising a banknote dispensing wheel 41, an adjustment wheel 42, and a plurality of impression wheels 43. The impression wheels 43 are preferably molded from rubber.

The driven gears 221 of the gear set 21 of the power module 2 are respectively coupled to the first wheel 31, the second wheel 32 and the third wheel 33, and driven by the motor 21 to rotate the wheels 31, 32, and 33. The first wheel 31, the second wheel 32, and the third wheel 33 are respectively partially inserted through the slots 121 of the substrate 12 into the inside space of the receiving chamber 13. Further, the banknote dispensing wheel 41, adjustment wheel 42, and impression wheels 43 of the output wheel set 4 are respectively peripherally disposed in contact with the periphery of the second wheel 32 of the transferring wheel set 3, and the adjustment wheel 42 is suspended above the second wheel 32. The position of the adjustment wheel 42 can be adjusted relative to the second wheel 32 to adjust the pitch between the periphery of the adjustment wheel 42 and the periphery of the second wheel 32.

Referring to FIGS. 3~8, when the user put a stack of banknotes 5 in the receiving chamber 13 inside the housing 1, the probe 1221 of the sensor 1221 is induced to start the motor 21, thereby causing the motor 21 to rotate the driven gears 221 and transmission gears 222 of the gear set 22 of the power module 2. When rotating the driven gears 221, the first wheel 31, second wheel 32, and third wheel 33 of the transferring wheel set 3 are synchronously rotated. During the rotary motion of the first wheel 31, the push block 311 is forced to push the stack of banknotes 5 toward the banknote dispensing wheel 41 of the output wheel set 4. When the stank of banknotes 5 touched the banknote dispensing wheel 41, the banknote dispensing wheel 41 spreads the stack of banknotes 5 into a stepped stack. When the push block 311 of the first wheel 31 passed over the stepped stack of banknotes 5, the stepped stack of banknotes 5 fell to the periphery of the rotating first wheel 31. However, the rotating first wheel 31 cannot transfer the banknotes 5 at this time (because the first wheel 31 has a smooth periphery that does not produce much friction when moved over the stepped stack of banknotes 5). Immediately thereafter, the push block 321 of the second wheel 32 is moved with the second wheel 32 over the bottom side of the stepped stack of banknotes 5, thereby causing the bottom banknote 5 to be pushed forwards to the gap in between the impression wheels 43

When the push block 321 of the second wheel 32 moved over the stack of banknotes 5, one banknote 5 is forced away from the stack of banknotes 5 into the gap between the adjustment wheel 42 and the second wheel 42 toward the impression wheel 43 and then transferred through the gap between the impression wheels 43 and the second wheel 32 and third wheel 33 to the outlet 11 of the housing 1. Therefore, one banknote 5 is transferred to the outlet 11 when the push block 321 rotated with the second wheel 32 through one turn. When all banknotes 5 carried away from the receiving chamber 13 to the outlet 1, the probe 1221 receives no signal, thereby causing the sensor 122 to output an off signal to turn off the motor 21. Because the first wheel 31 and the second wheel 32 are synchronously rotated and the length of the circumference of the first wheel 31 and the second wheel 32 is greater than the length of the banknotes 5, the push block 311 or 321 pushes one banknote 5 only when the wheel 31 or 32 rotated through one turn. The pitch between the adjustment wheel 42 and the second wheel 32 is approximately equal to the thickness of one banknote 5. Therefore, only one banknote 5 can be transferred through the gap between the adjustment wheel 42 and the second wheel 32 at a time.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A banknote dispenser comprising:

a housing, said housing comprising a banknote outlet, a substrate provided on the inside, and a receiving chamber defined on the inside above said substrate and adapted to hold a stack of banknotes;

a power module mounted in said housing below said substrate, said power module comprising a motor and a gear set coupled to said motor;

a transferring wheel set coupled to said gear set and adapted to transfer banknotes from said receiving chamber to said banknote outlet, said transferring wheel set comprising a first wheel, a second wheel, and a third wheel respectively coupled to said gear set of said power module for synchronous rotation, said first wheel comprising a push block adapted to spread a stack of banknotes been put in said receiving chamber into a stepped stack of banknotes, said second wheel comprising a push block adapted to dispense the stepped stack of banknotes; and an output wheel set adapted to transfer banknotes individually from said transferring wheel set to said banknote outlet, said output wheel set comprising a banknote dispensing wheel adapted to work with the push block of said first wheel in spreading a stack of banknotes been put in said receiving chamber into a stepped stack of banknotes, an adjustment wheel adapted to work with said second wheel in transferring banknotes individually from said banknote dispensing wheel toward said banknote outlet, and a plurality of impression wheels peripherally disposed in contact with said second wheel and said third wheel and adapted to transfer banknotes individually from said adjustment wheel toward said banknote outlet.

2. The banknote dispenser as claimed in claim 1, wherein said substrate comprises a sensor adapted to turn on/off said motor of said power drive subject to the presence/non-presence condition of banknotes in said receiving chamber, said sensor having a probe suspended in said receiving chamber and adapted to detect the presence of banknotes in said receiving chamber.

3. The banknote dispenser as claimed in claim 1, wherein said gear set of said power module comprises a plurality of driven gears and a plurality of transmission gears, said driven gears being respectively coupled to said first wheel, said second wheel, and said third wheel.

4. The banknote dispenser as claimed in claim 3, wherein said transmission gears are respectively meshed between each two adjacent driven gears.

5. The banknote dispenser as claimed in claim 1, wherein said substrate has a plurality of slots; said first wheel, said second wheel, and said third wheel are respectively partially inserted through the slots of said substrate into the inside space of said receiving chamber.

6. The banknote dispenser as claimed in claim 1, wherein the length of the circumference of said first wheel and said second wheel is greater than the length of the banknotes to be dispensed.

7. The banknote dispenser as claimed in claim 1, wherein the push blocks of said first wheel and said second wheel are molded from rubber.

8. The banknote dispenser as claimed in claim 1, wherein the push blocks of said first wheel and said second wheel are toothed.

9. The banknote dispenser as claimed in claim 1, wherein the first, second and third wheels of said transferring wheel set are smooth wheels each having a smooth periphery.

10. The banknote dispenser as claimed in claim 1, wherein said banknote dispensing wheel of said output wheel set is disposed in contact with the periphery of said second wheel.

11. The banknote dispenser as claimed in claim 1, wherein said impression wheels of said output wheel set are peripherally disposed in contact with said second wheel and said third wheel.

12. The banknote dispenser as claimed in claim 1, wherein said impression wheels of said output wheel set are respectively molded from rubber.

* * * * *